US010952916B2

(12) United States Patent
Killian

(10) Patent No.: US 10,952,916 B2
(45) **Date of Patent: *Mar. 23, 2021**

(54) PORTABLE URINAL MOUNTING ASSEMBLY

(71) Applicant: James M. Killian, Houston, TX (US)

(72) Inventor: James M. Killian, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/385,707

(22) Filed: Apr. 16, 2019

(65) Prior Publication Data

US 2019/0240104 A1 Aug. 8, 2019

Related U.S. Application Data

(63) Continuation of application No. 15/297,206, filed on Oct. 19, 2016, now Pat. No. 10,258,532.

(51) Int. Cl.

| | |
|---|---|
| ***A61G 9/00*** | (2006.01) |
| ***A61H 3/00*** | (2006.01) |
| ***A47K 11/12*** | (2006.01) |

(52) U.S. Cl.

CPC ..... *A61H 3/00* (2013.01); *A47K 11/12* (2013.01); *A61G 9/006* (2013.01); *A61H 2003/002* (2013.01)

(58) Field of Classification Search

CPC ..... A47K 11/12; A61G 5/10; A61G 5/1002; A61G 5/102; A61G 5/1094; A61G 9/006; A61H 3/00

USPC ..... 135/67; 224/148.6, 407, 409, 926; 248/102, 104, 318, 693; 4/144.1, 454, 4/457, 484, 661; 604/322–326, 346–347

See application file for complete search history.

(56) References Cited

U.S. PATENT DOCUMENTS

| | | | | |
|---|---|---|---|---|
| 2,399,320 A | | 4/1946 | Brose et al. | |
| 3,473,772 A | * | 10/1969 | Nilson | A61G 7/0503 248/214 |
| 4,270,231 A | | 6/1981 | Zint | |
| 4,606,736 A | * | 8/1986 | Van De Weghe | A61F 5/44 604/322 |
| 4,901,375 A | * | 2/1990 | Dahlgren | A61F 5/44 224/148.2 |
| 4,974,760 A | | 12/1990 | Miller | |
| 5,288,001 A | | 2/1994 | Locarno | |
| 5,722,096 A | | 3/1998 | Pfaeffle | |

(Continued)

OTHER PUBLICATIONS http://www.seniorsstore.ca/Mobility-Walkers/c14_68/index.html, retrieved Jul. 22, 2016.

(Continued)

*Primary Examiner* — David P Angwin
*Assistant Examiner* — Nicholas A Ros
(74) *Attorney, Agent, or Firm* — Bracewell LLP; Douglas W. Rommelmann

(57) ABSTRACT

A portable urinal mounting assembly selectively connectable to a walker having a pair of side support assemblies including upper and lower support braces. The mounting assembly comprises an body sleeve adapted to receive a portable urinal. Front left and right straps and rear left and right straps are attached to the body sleeve. Each of the front and rear left and right straps have an end portion including an attachment device. The end portions of the straps are arranged and designed to be removably secured to the upper and lower support braces of the pair of side support assemblies.

25 Claims, 4 Drawing Sheets

(56) References Cited

U.S. PATENT DOCUMENTS

| | | | | |
|---|---|---|---|---|
| 5,743,650 | A | 4/1998 | Shannon et al. | |
| 6,065,726 | A | 5/2000 | Pfaeffle | |
| 6,116,551 | A | 9/2000 | Pfaeffle | |
| 6,241,388 | B1 * | 6/2001 | Terramani | A47K 3/281 206/581 |
| 6,406,463 | B1 | 6/2002 | Brown | |
| 7,398,951 | B1 * | 7/2008 | Sugalski | A61G 7/0503 248/214 |
| 7,510,157 | B2 * | 3/2009 | Oliver | A45C 13/28 220/739 |
| D601,794 | S | 10/2009 | Jarvio | |
| 8,122,527 | B2 * | 2/2012 | Ruttier | A47K 11/04 4/484 |
| 10,258,532 | B2 * | 4/2019 | Killian | A61G 9/006 |
| 2012/0097720 | A1 | 4/2012 | Lee | |
| 2013/0256357 | A1 | 10/2013 | Prosperie | |

OTHER PUBLICATIONS

ISRWO dated Dec. 26, 2017 International Search Report and Written Opinion dated Dec. 26, 2017 for corresponding PCT/US2017/055790.

* cited by examiner

PORTABLE URINAL MOUNTING ASSEMBLY

CROSS-REFERENCE TO RELATED APPLICATIONS

This application is a continuation of U.S. patent application Ser. No. 15/297,206, filed Oct. 19, 2016, issued as U.S. Pat. No. 10,258,532.

BACKGROUND OF THE INVENTION

1. Field of the Invention

This invention relates generally to portable urinals and more particularly to portable urinals for attachment to a walking assistance device, such as a standard walker.

2. Description of the Related Art

Personal mobility is limited for many individuals, particularly as we grow old and become weak. For many such individuals the ability to walk or even just to stand requires assistance from a caregiver or the use of a walking device, typically referred to as a walker in the healthcare field.

It is common in the healthcare field to employ portable in-bed or stand-up handheld urinals for male bed-ridden patients. Urinal bottles have been used for many years to allow a bed-ridden individual to urinate while lying in the prone or side position. However, the bladder cannot be completely emptied when lying in the bed and, as a result, the individual may have to urinate more frequently.

Typical portable stand-up handheld urinal devices fail to provide support for the individual using the device. These devices are typically used by disabled or bed-ridden individuals who need assistance to stand.

U.S. Pat. No. 6,065,726 discloses a portable urinal holder connectable to a walker which can be used while standing. The holder includes an elongated adaptor having a plurality of rods extending such that a receiving area of one end of a telescoping support may be coupled to the adapter at any of multiple locations on the adapter. The adapter also includes a pair of members for connecting to the walker. A second end of the telescoping support includes a bottle receiving area for coupling to the urine bottle. The telescoping support includes an outer hollow rod slidable on an inner rod and a stop screw to lock the length of the telescoping support.

It would be desirable to have a portable "hands free" urinal which can be utilized in the standing position by disabled, partially disabled or bed-ridden males. It would be further desirable to have a portable urinal that can be used while the male user has support to stand. It would be further desirable to provide a portable urinal which is attachable to a standard walker that can be used while standing. It would also be desirable to provide a portable urinal that can be used while standing that is positionally adjustable. It would also be desirable to have a portable urinal that is easy to mount to a walker, lightweight, made substantially of non-rigid components, and easy to clean and sterilize.

SUMMARY OF THE INVENTION

The preferred embodiment of the present invention is a portable urinal mounting assembly selectively connectable to a walker having a pair of side support assemblies including upper and lower support braces. The mounting assembly comprises a body sleeve adapted to receive a portable urinal.

Front left and right straps and rear left and right straps are attached to the body sleeve. Each of the front and rear left and right straps have an end portion including an attachment device. The end portions of the straps are arranged and designed to be removably secured to the upper and lower support braces of the pair of side support assemblies.

Upon attachment of the preferred embodiment of the portable urinal mounting assembly to the walker, a portable "hands-free" urinal is provided which can be utilized in the standing position by disabled, partially disabled or bed-ridden males. The user has a hands-free portable urinal that can be used while having support to stand. Additionally, the hands-free portable urinal is positionally adjustable in height and angular orientation. The portable urinal mounting assembly is easy to mount to a walker, lightweight, made substantially of non-rigid components, and easy to clean and sterilize.

BRIEF DESCRIPTION OF THE SEVERAL VIEWS OF THE DRAWINGS

The advantages and features of the invention will become more apparent by reference to the drawings which are appended hereto, wherein like reference numbers indicate like parts, and wherein an illustrative embodiment the invention is shown, of which.

DESCRIPTION OF THE PREFERRED EMBODIMENTS

Figure 1:
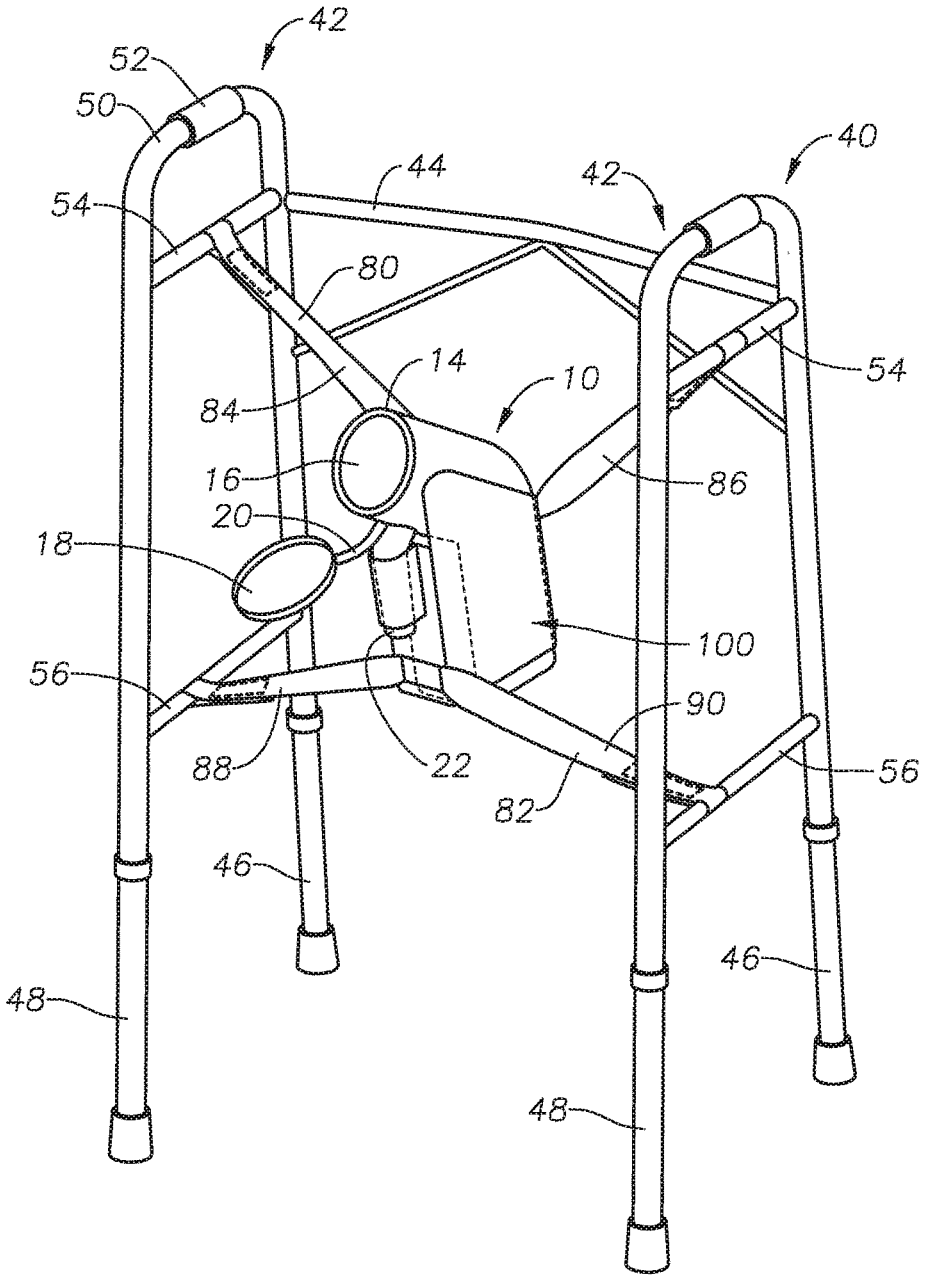
FIG. 1 is a rear, right side perspective view showing a preferred embodiment of the portable urinal mounting assembly of the present invention, with a portable urinal, mounted to a conventional walker.

The invention will now be described in more detail with specific reference to the figures. FIG. 1 depicts a preferred embodiment of the portable urinal mounting assembly 100, with a conventional portable male urinal 10, mounted to a conventional walker 40.

Figure 2:
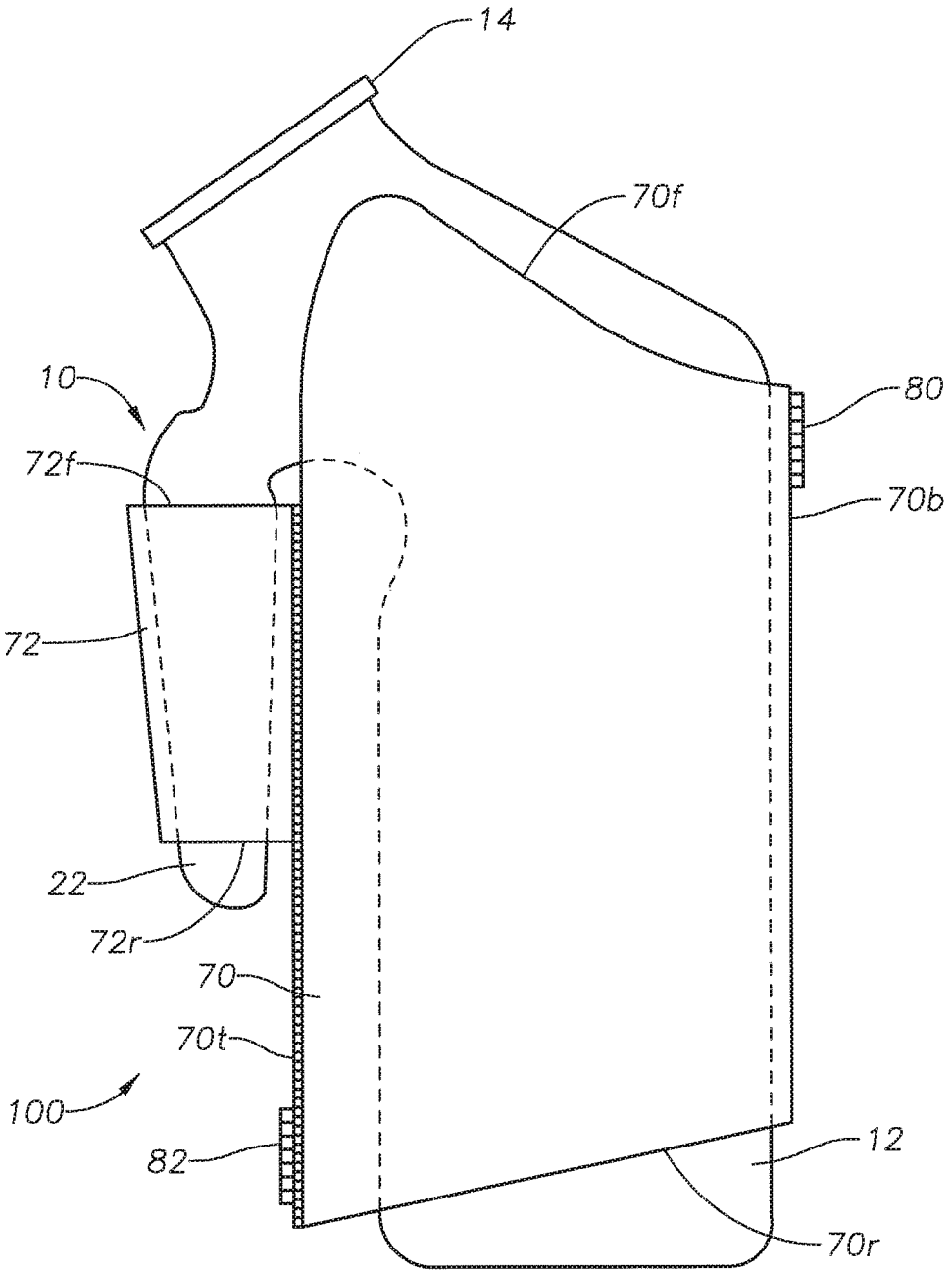
FIG. 2 is a side view of the portable urinal received within the portable urinal mounting assembly.
Figure 4:
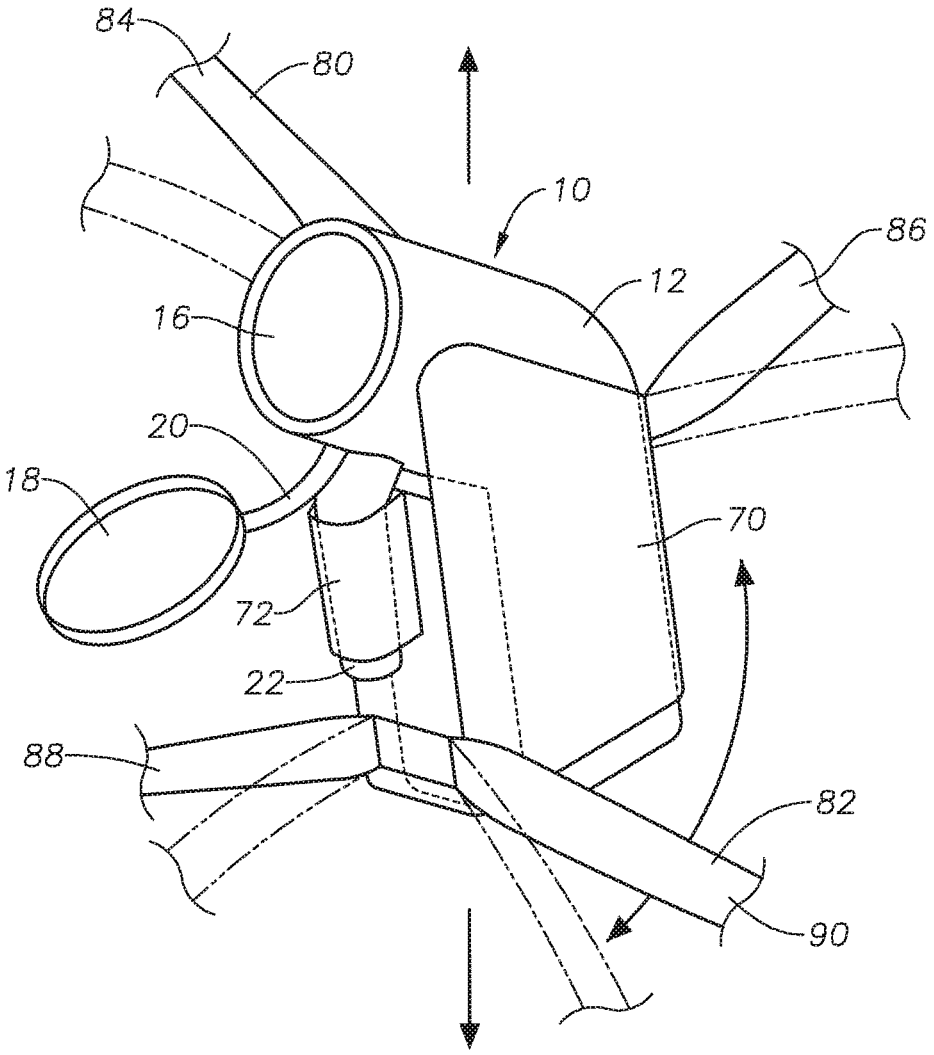
FIG. 4 is a partial view of the portable urinal mounting assembly with the portable urinal in an installed orientation, the broken lines showing various positions for the straps.

Referring to FIGS. 1, 2 and 4, the urinal 10 is an elongate bottle-like container having a generally elongate main body 12 and an angled opening end 14 having an orifice 16. The orifice 16 is adapted to be closed by a removable cap or lid 18, preferably of the snap-on type as shown in FIG. 1. The cap 18 is preferably connected to the urinal 10 by a tether 20 to avoid dropping or losing the cap 18. The urinal 10 also typically includes a handle 22 formed of cantilever style. As illustrated in the figures, the handle 22 is preferably integral with the elongate main body 12.

FIG. 1 depicts a conventional walker 40 commonly used by individuals needing some assistance to walk or stand. The walker 40 includes a pair of side support assemblies 42, typically mirror images of one another, joined together by front bracing 44. Each side support assembly 42 includes front and rear legs 46 and 48, respectively, that are substantially upright but are slightly angled towards each other from the lower to upper ends of the legs 46 and 48. The upper ends of the front and rear legs 46 and 48 are joined by an upper, generally horizontal member 50 defining a gripping portion or handle 52. The walker 40 typically includes upper and lower side support braces 54 and 56, respectively, each connected to the front and rear legs 46 and 48 at different elevations.

Figure 3:
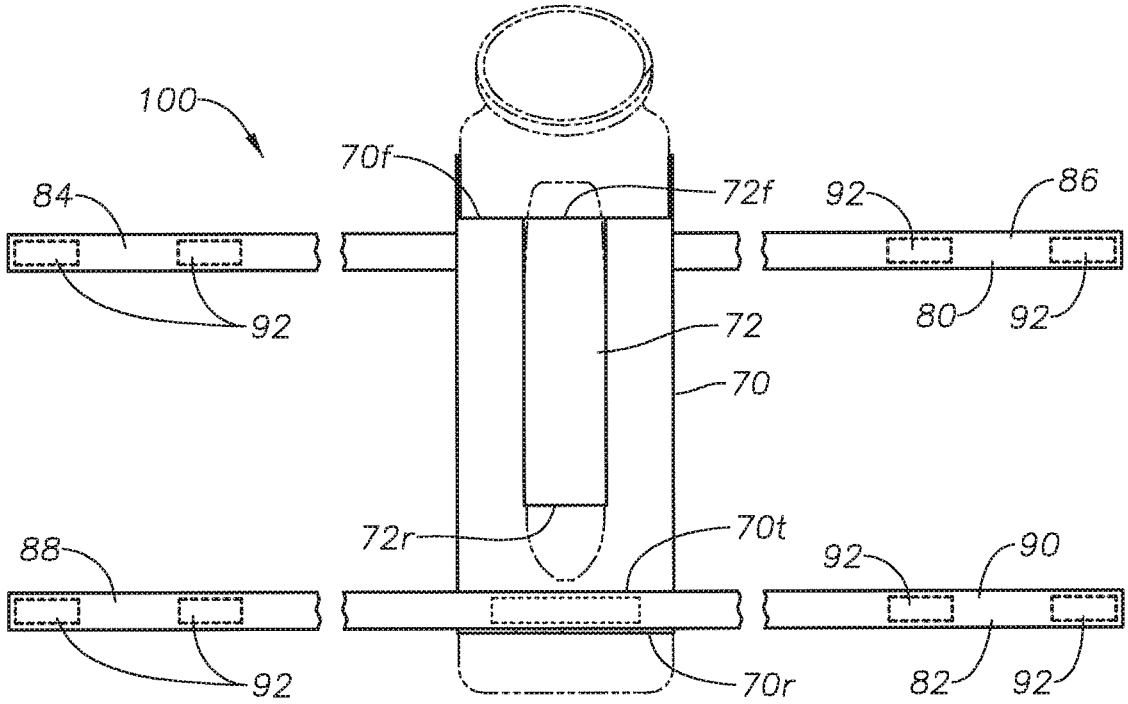
FIG. 3 is a top view of the portable urinal mounting assembly with the portable urinal shown in broken lines.

As shown in FIGS. 2 and 3, the preferred embodiment of the portable urinal mounting assembly 100 includes a body sleeve or pocket 70 and a handle sleeve 72. The body sleeve 70 is arranged and designed to slidably receive the elongate main body 12 and the handle sleeve 72 is arranged and designed to slidably receive the handle 22 of the urinal 10. Receipt of the handle 22 in the handle sleeve 72 substantially prevents rotational movement of the main body 12 within the body sleeve 70. The handle sleeve 72 is positioned above the body sleeve 70 in FIG. 3. In an alternative embodiment the handle sleeve 72 may be omitted.

In the preferred embodiment, the body sleeve 70 and handle sleeve 72 are open at both the front ends 70*f* and 72*f*, respectively, and the rear ends 70*r* and 72*r*, respectively. This is beneficial from a sanitation perspective.

The portable urinal mounting assembly 100 also includes a front strap 80 and a rear strap 82. The front strap 80 is attached to a bottom portion 70*b* near the front end 70*f* of the body sleeve 70 such that the length of the front strap 80 extends transverse to the body sleeve 70. The front strap 80 is attached at substantially its mid length to the body sleeve 70 such that approximately equal lengths of the front strap 80 extend to either side of the body sleeve 70. As a result, the front strap 80 defines a front left strap 84 and a front right strap 86.

The rear strap 82 is attached to a top portion 70*t* near the rear end 70*r* of the body sleeve 70 such that the length of the rear strap 82 extends transverse to the body sleeve 70. The rear strap 82 is attached at substantially its mid length to the body sleeve 70 such that approximately equal lengths of the rear strap 82 extend to either side of the body sleeve 70. As a result, the rear strap 82 defines a rear left strap 88 and a rear right strap 90.

Each of the front left and right straps 84 and 86 and rear left and right straps 88 and 90 include attachment or fastening devices 92 at or near the free ends of the straps. In a preferred embodiment the fastening devices include mating hook and loop fasteners, such as sold under the registered trademark VELCRO®, owned by Velcro Industries B.V. It is to be understood that other types of attachment or fastening devices may be used, including, but not limited to, snaps, buttons, hooks, etc.

The body sleeve 70, handle sleeve 72 and straps 80 and 82 are preferably made of a clear, flexible material including, but not limited to, vinyl or plastic.

Preferably, the portable urinal mounting assembly 100 is made of materials that can withstand high temperatures for sterilizing and be washed in hot water.

The installation of the portable urinal mounting assembly 100 to a conventional walker 40 will now be explained. Preferably, the elongate main body 12 of the conventional portable male urinal 10 is inserted in the open front end 70*f* of the body sleeve 70 and the handle 22 is inserted in the open front end 72*f* of the handle sleeve 72. The urinal 10 is inserted as far as possible into the body sleeve 70; typically to the point where the cantilever handle 22 abuts the upper front end 70*f* of the body sleeve 70 and limits further insertion.

The portable urinal mounting assembly 100 is positioned between the pair of side support assemblies 42 of the walker 40 with the elongate body 12 of the portable urinal 10 substantially vertically oriented with the opening 16 facing towards the rear of the walker 40. The front left and right straps 84 and 86 are looped around the left and right upper side support braces 54 and temporarily secured thereto via the fasteners 92. The rear left and right straps 88 and 90 are looped around the left and right lower side support braces 56 and temporarily secured thereto via the fasteners 92. Final adjustment of the strap length and positioning along the upper and lower side support braces can then be done to position the urinal 10 at the desired height and location for the user as shown in FIG. 4.

The preferred embodiment of the present invention provides many benefits and conveniences:

The portable urinal 10 is easily removable for emptying or storage from the portable urinal mounting assembly 100 attached to the walker 40 by simply grasping the angled opening end 14 and sliding the urinal 10 out of the body and handle sleeves 70 and 72, respectively.

The height of the urinal opening 16 is adjustable via adjustment of the lengths of the front straps 84 and 86 and the rear straps 88 and 90 as shown in FIG. 4.

The angle of the urinal opening 16 and the urinal 10 is adjustable by sliding the position of the front straps 84 and 86 along the upper side support braces 54 and/or by sliding the position of the rear straps 88 and 90 along the lower side support braces 56.

The portable urinal mounting assembly 100 is easily and quickly attached or mounted to a walker. Additionally, the portable urinal mounting assembly 100 is easily and quickly detached from a walker.

The portable urinal mounting assembly 100 can be easily cleaned and sterilized.

The portable urinal mounting assembly 100 can be used with different brands or models of walkers, including walkers having different sizes and spacings between side support braces 54 and 56.

The adjustable placement of the portable urinal 10 relative to the front of the walker 40 allows the urinal 10 to be positioned such that the user may use the handle(s) 52 of the walker 40 while urinating.

While the invention has been described in detail above with reference to specific embodiments, it will be understood that modifications and alterations in the embodiments disclosed may be made by those practiced in the art without departing from the spirit and scope of the invention. All such modifications and alterations are intended to be covered.

I claim:

1. A portable male urinal mounting assembly connected to a walker having a pair of side support assemblies joined together by front bracing, each of the side support assemblies including upper and lower support braces and a gripping portion, and a portable male urinal bottle comprising an elongate container having an orifice, the portable male urinal mounting assembly comprising:

a body sleeve having an open front end for receiving the elongate container of the portable male urinal bottle;

a front left strap and a front right strap attached to the body sleeve;

a rear left strap and a rear right strap attached to the body sleeve;

each of the front and rear left and right straps having an end portion including an attachment device, wherein the end portions of the straps are removably secured to the upper and lower support braces of the pair of side support assemblies so that the body sleeve is positioned between the pair of side support assemblies of the walker and a user of the portable male urinal bottle may use the gripping portions of the walker to maintain vertical stability or support to stand while urinating.

2. The portable male urinal mounting assembly of claim 1, wherein the front left and right straps are attached to a bottom portion of the body sleeve and the rear left and right straps are attached to a top portion of the body sleeve.

3. The portable male urinal mounting assembly of claim 1, wherein the end portions of the front and rear straps loop around the support braces.

4. The portable male urinal mounting assembly of claim 1, wherein the vertical position of the body sleeve is adjustable via the securement and placement of the end portions of the straps with respect to the upper and lower support braces.

5. The portable male urinal mounting assembly of claim 1, wherein the angular orientation of the body sleeve is adjustable via the securement and placement of the end portions of the straps with respect to the upper and lower support braces.

6. The portable male urinal mounting assembly of claim 1, wherein the body sleeve and front and rear left and right straps are made of a flexible material.

7. The portable male urinal mounting assembly of claim 1, wherein the front left and right straps are attached proximate a front end of the body sleeve and the rear left and right straps are attached proximate a rear end of the body sleeve.

8. The portable male urinal mounting assembly of claim 7, wherein the front left and right straps are attached to a bottom portion of the body sleeve and the rear left and right straps are attached to a top portion of the body sleeve.

9. The portable urinal mounting assembly of claim 1, further comprising a handle sleeve attached to the body sleeve, the handle sleeve receiving a handle of the portable urinal bottle.

10. The portable male urinal mounting assembly of claim 9, wherein the handle sleeve is directly attached to a top portion of the body sleeve.

11. The portable male urinal mounting assembly of claim 1, wherein the body sleeve is open at a rear end.

12. The portable male urinal mounting assembly of claim 11, wherein the front left and right straps are attached proximate the front end of the body sleeve and the rear left and right straps are attached proximate the rear end of the body sleeve.

13. The portable male urinal mounting assembly of claim 12, wherein the front left and right straps are attached to a bottom portion of the body sleeve and the rear left and right straps are attached to a top portion of the body sleeve.

14. A portable male urinal mounting assembly connected to a walker apparatus having a pair of side support assemblies joined together by front bracing, each side support assembly including upper and lower support braces and a gripping portion, the portable male urinal mounting assembly comprising:

a urine bottle comprising an elongate main body, an angled opening end having an orifice, the urine bottle having a cantilevered handle;

a body sleeve having an open front end, wherein the elongate main body is removably positioned within the body sleeve; and a plurality of straps attached to the body sleeve, each strap having an end portion including an attachment device, wherein the end portions of the straps are removably secured to the upper and lower support braces of the pair of side support assemblies so that the urine bottle is positioned between the pair of side support assemblies of the walker apparatus and a user of the urine bottle may use the gripping portions of the walker apparatus to maintain vertical stability or support to stand while urinating.

15. The portable male urinal mounting assembly of claim 14, wherein the body sleeve has an open rear end.

16. The portable male urinal mounting assembly of claim 14, wherein the plurality of straps allow positioning of the orifice of the urine bottle at a desired height and angular orientation for a user.

17. The portable male urinal mounting assembly of claim 14, wherein the plurality of straps comprises:

a front left strap and a front right strap attached to the body sleeve; and a rear left strap and a rear right strap attached to the body sleeve.

18. The portable male urinal mounting assembly of claim 17, wherein the front left and right straps are attached proximate the front end of the body sleeve and the rear left and right straps are attached proximate a rear end of the body sleeve.

19. The portable male urinal mounting assembly of claim 17, wherein the front left and right straps are attached to a bottom portion of the body sleeve and the rear left and right straps are attached to a top portion of the body sleeve.

20. A height adjustable and angular adjustable portable male urinal mounted to a walker apparatus having a pair of side support assemblies joined together by front bracing, each side support assembly including upper and lower support braces and a gripping portion, the portable male urinal comprising:

a urine bottle comprising an elongate main body and having an orifice;

a body sleeve having a top portion and a bottom portion, a rear end and an open front end, wherein the elongate main body is removably positioned within the body sleeve;

front left and right straps attached to the bottom portion of the body sleeve near the front end, each of the front straps having an end portion including a front strap attachment device, the front strap attachment devices securing the front left strap to the left upper side support brace and the front right strap to the right upper side support brace;

rear left and right straps attached to the top portion of the body sleeve near the rear end, each of the rear straps having an end portion including an rear strap attachment device, the rear strap attachment devices securing the rear left strap to the left lower side support brace and the rear right strap to the right lower side support brace, wherein the urine bottle is positioned between the pair of side support assemblies of the walker apparatus and a user of the portable male urinal may use the gripping portions of the walker apparatus to maintain vertical stability or support to stand while urinating.

21. The portable male urinal of claim 20, wherein the body sleeve has an open rear end.

22. The portable male urinal of claim 20, wherein the height of the urine bottle orifice is adjustable by adjusting the lengths of the front and rear straps.

23. The portable male urinal of claim 20, wherein the angle of the urine bottle orifice is adjustable by sliding the position of the front straps along the upper side support braces and/or by sliding the position of the rear straps along the lower side support braces.

24. The portable male urinal of claim 20, further comprising:

the urine bottle having a cantilevered handle; and the body sleeve having an open rear end.

25. The portable male urinal of claim 24, further comprising a handle sleeve attached to the body sleeve, the handle sleeve receiving the cantilevered handle of the urine bottle.

* * * * *